US007334625B2

(12) United States Patent
Judge et al.

(10) Patent No.: US 7,334,625 B2
(45) Date of Patent: Feb. 26, 2008

(54) MANUFACTURE OF CASTING CORES

(75) Inventors: Nicholas D. Judge, Olney, IL (US); Joseph J. Parkos, Jr., East Haddam, CT (US); Gary M. Lomasney, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 13 days.

(21) Appl. No.: 11/230,080

(22) Filed: Sep. 19, 2005

(65) Prior Publication Data

US 2007/0227683 A1 Oct. 4, 2007

(51) Int. Cl.
*B22C 9/00* (2006.01)

(52) U.S. Cl. ..... 164/28; 164/30; 164/31; 164/32

(58) Field of Classification Search ..... 164/28, 164/30, 31, 32, 228, 302, 369, 370
See application file for complete search history.

(56) References Cited

U.S. PATENT DOCUMENTS 3,518,134 A * 6/1970 Preist ..... 216/51
4,287,932 A 9/1981 Schneider
4,411,730 A * 10/1983 Fishter et al. ..... 216/94
4,509,254 A * 4/1985 Damrow et al. ..... 29/623.5
5,302,414 A 4/1994 Alkhimov et al.
5,509,556 A * 4/1996 Balz et al. ..... 216/56
5,616,229 A 4/1997 Samsonov et al.
5,915,452 A * 6/1999 Conroy et al. ..... 164/345
6,039,815 A * 3/2000 Yeol et al. ..... 134/2
6,197,178 B1 3/2001 Patel et al.
6,365,028 B1 4/2002 Shatrov
6,637,500 B2 10/2003 Shah et al.
6,668,906 B2 * 12/2003 Burd ..... 164/302
6,929,054 B2 8/2005 Beals et al.

* cited by examiner

*Primary Examiner*—Kevin Kerns
*Assistant Examiner*—I.-H. Lin
(74) *Attorney, Agent, or Firm*—Bachman & LaPointe, P.C.

(57) ABSTRACT

A method for forming an investment casting core comprises cutting a patterned core precursor from refractory metal-based sheet. The cutting forms recast along the cuts. An oxide is grown on non-recast areas. The recast is substantially chemically removed but substantially leaving the oxide. The core precursor may then be shaped.

25 Claims, 2 Drawing Sheets

MANUFACTURE OF CASTING CORES

BACKGROUND OF THE INVENTION

The invention relates to investment casting. More particularly, the invention relates to refractory metal cores for forming internal features in superalloy castings.

Investment casting is a commonly used technique for forming metallic components having complex geometries, especially hollow components, and is used in the fabrication of superalloy gas turbine engine components.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

The ceramic cores themselves may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile.

Commonly-assigned co-pending U.S. Pat. No. 6,637,500 of Shah et al. discloses general use of refractory metal cores in investment casting among other things. Various refractory metals, however, tend to oxidize at higher temperatures, e.g., in the vicinity of the temperatures used to fire the shell and the temperatures of the molten superalloys. Thus, the shell firing may substantially degrade the refractory metal cores and, thereby produce potentially unsatisfactory part internal features. Use of protective coatings on refractory metal core substrates may be necessary to protect the substrates from oxidation at high temperatures.

SUMMARY OF THE INVENTION

Forming fine features presents difficulties even with refractory metal cores. There is a particular adverse synergy of manufacture techniques. Specifically, laser cutting is an advantageous technique for forming fine features in thin refractory metal sheets. However, the heating generated by laser cutting tends to create a brittle recast layer along the cut. During subsequent forming and/or handling, crack initiation in the recast layer may propagate cracks into and through the base metal. This may result in the breaking of the fine core branches. It is desirable to remove the recast to control such cracking. However, basic chemical means would tend to remove about the same depth of base material away from the cuts as the depth of recast removed along the cuts. This can compromise dimensional integrity, including adversely affecting predictability and consistency. Accordingly, it is desirable to preferentially remove the recast.

Accordingly, one aspect of the invention involves a method for forming an investment casting core comprises cutting a patterned core precursor from refractory metal-based sheet. The cutting forms recast along the cuts. An oxide is grown on non-recast areas. The recast is substantially chemically removed (e.g., the chemical means are more responsible than any other means). The removal substantially leaves the oxide (e.g., a majority, typically in excess of 90%). The core precursor may then be shaped.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
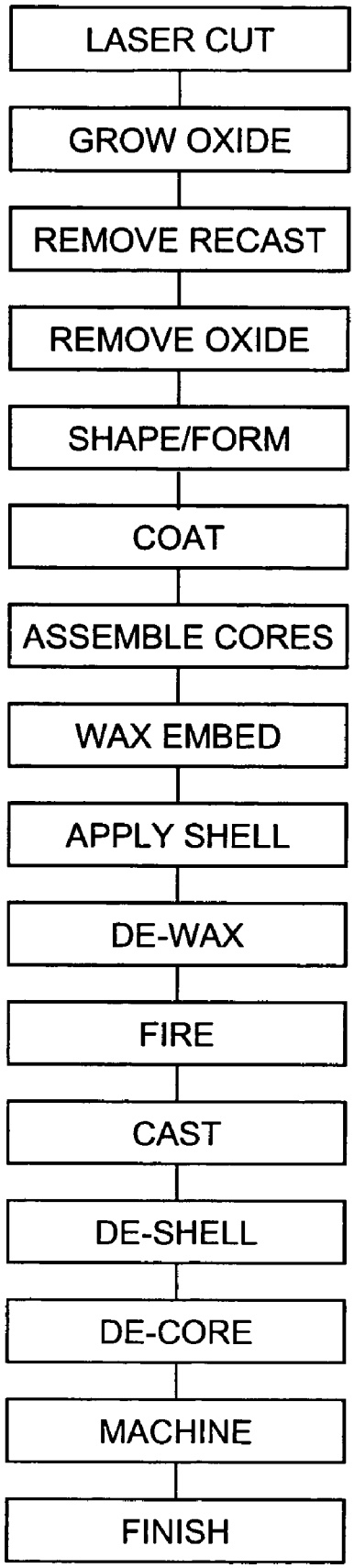
FIG. 1 is a flowchart of a process for manufacturing and using a refractory metal core.

FIG. 1 shows an exemplary process of refractory metal core (RMC) manufacture and use (simplified for illustration). The core precursor(s) are formed by a process including laser cutting. For example, the laser may be used for all cutting (i.e., cutting the precursor from a larger sheet and then cutting both large scale and small scale features). Alternatively, gross cutting may be by mechanical means such as die cutting from sheet stock followed laser cutting of the finer, smaller scale features (e.g., core legs forming cooling outlets). Exemplary sheet material is essentially pure molybdenum. The laser cutting forms recast material along the cuts.

Figure 2:
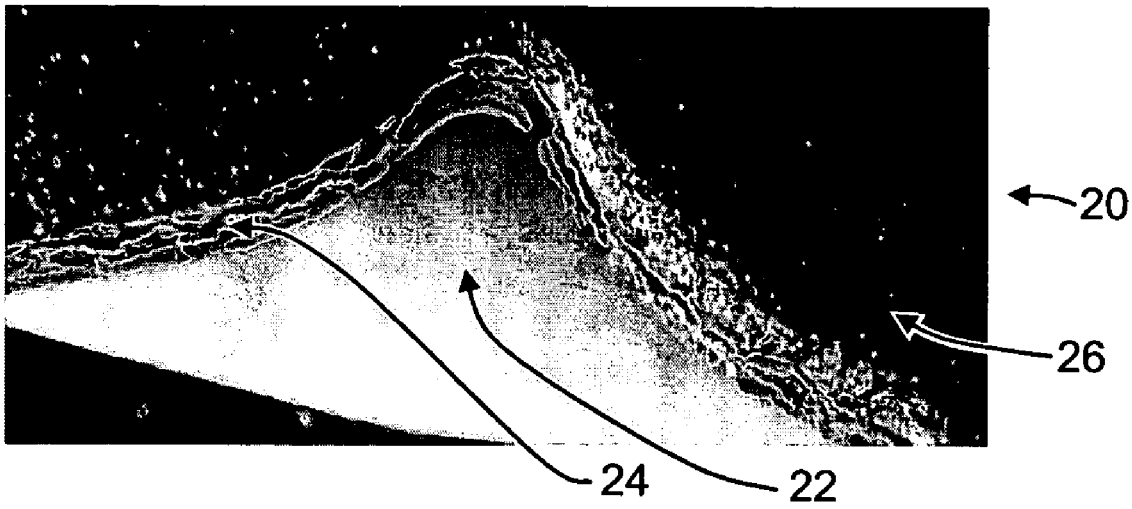
FIG. 2 is a photograph of a laser cut aperture in a molybdenum core post oxidation and with recast.

As a prelude to removing the recast, an oxide is grown over non-recast areas. Exemplary oxide is thermally grown (TGO), although chemically grown oxide is possible. An exemplary oxidation process involves heating in an air circulating oven. Heating time and temperature may be selected to form enough molybdenum oxide to act as a maskant but not so much as to adversely affect dimensional tolerances. An exemplary time and temperature are 60±5 minutes at 700±25° F. (357-385° C.). The parts may be inserted into a preheated oven and removed an allowed to air cool. Exemplary oxide yields are less than 25 μm (1-12.5 μm). Various forms of molybdenum oxide may be formed during this process FIG. 2 shows a molybdenum core 20 having a laser cut aperture 22. An exemplary core is formed from ~0.35 mm thick sheet stock (e.g., 0.10-0.20 inch (0.25-0.51 mm)). Recast 24 is present along the cut perimeter of the aperture. An oxide layer 26 is shown along each of the two core faces resulting in a slight thickness increase (e.g., to ~0.38 mm). The recast 24 appears with a brittle laminar structure.

After oxide growth, the recast is substantially removed. Exemplary removal is chemical, by means of chemical milling such as acidic milling. An exemplary acid is a water and nitric/sulfuric acid mixture (e.g., 50% nitric, 5% sulfuric, and 45% water by volume). Exemplary removal may be at essentially ambient conditions (atmospheric pressure and at 65-75° F. (18-24° C.)). The removal may involve immersion and mechanical agitation. An exemplary immersion time is 45±5 seconds. Solution composition and time may be varied in order to meet recast removal requirements.

The amount of recast will vary with laser intensity. Exemplary recast thickness is 2.5-12.5 μm. Exemplary removal removes at least 90% of the recast at critical bend areas without substantially effecting the non-recast areas.

Optionally, after recast removal, the oxide may be substantially removed. Exemplary removal is chemical, by means of chemical milling such as alkaline milling. The part may be immersed in an alkaline solution. Exemplary immersion is at ambient pressure and slightly elevated temperature Exemplary solution, time, and temperature parameters are a pH of 10-12, for ~10 seconds, at 140±10° F. (54-66° C.). An exemplary alkaline solution is available from Enthone, Inc. of West Haven, Conn. under the trade mark ENPREP 35.

Exemplary removal removes at least 90% of the oxide and preferably essentially all. The amount of overall base material lost will depend upon the amount of oxide present. The oxide is converted base material and will result in that much stock loss. Exemplary values are ~5-15 μm. Material loss at the laser cut features (e.g., holes and the like) may be essentially equal to the recast thickness (e.g., 2.5-12.5 μm).

Figure 3:
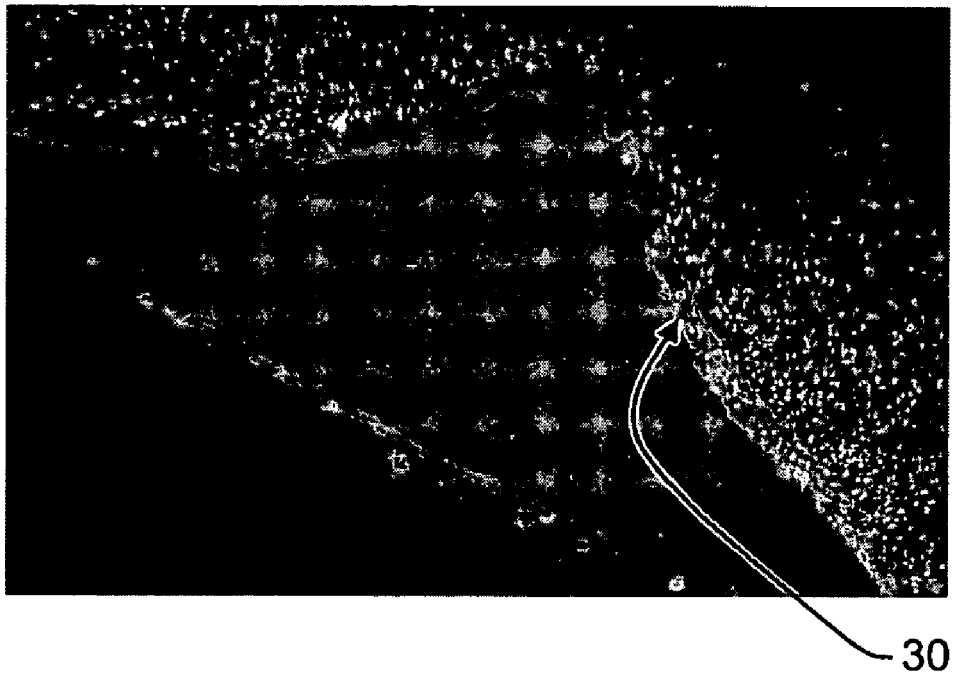
FIG. 3 is a photograph of a laser cut aperture in a molybdenum core after recast and oxidation removal.

FIG. 3 shows a core aperture having a perimeter 30 from which the recast has substantially been cleared.

The cut core precursor may be shaped/formed (e.g., by bending) to provide a relatively convoluted shape for casting the desired features. Optionally, after or before shaping/forming, a protective coating may be applied. Some exemplary coatings are metallic. Exemplary deposition process may be a physical or chemical deposition process. Exemplary physical deposition processes are ion vapor deposition (IVD) and cold spray deposition. Exemplary IVD and cold spray deposition techniques are shown in U.S. Military Standard Mil-C-83488 (for pure Al) and U.S. Pat. No. 5,302,414 of Alkhimov et al., respectively. Exemplary chemical processes include electrolytic plating. The deposited layer may then be at least partially oxidized. Exemplary oxidation is via chemical process such as anodizing, hard coating (a family of high voltage anodizing processes), and micro-arc oxidation. Exemplary micro-arc processes are shown in U.S. Pat. Nos. 6,365,028, 6,197,178, and 5,616,229. Other exemplary coatings are ceramic.

The RMC may then be assembled with other cores (e.g., other RMCs and/or ceramic feed core(s)) Exemplary ceramic feed cores may be formed separately (e.g., by molding from silicon-based material) or formed as part of the assembling (e.g., by molding the feed core partially over the RMCs). The assembling may also occur in the assembling of a die for overmolding the core assembly with wax or wax-like material to at least partially embed the core(s). The overmolding forms a pattern which is then shelled (e.g., via a multi-stage stuccoing process forming a silica-based shell). The wax material is removed (e.g., via steam autoclave). After any additional mold preparation (e.g., trimming, firing, assembling), a casting process introduces one or more molten metals and allows such metals to solidify. The shell is then removed (e.g., via mechanical means). The core assembly is then removed (e.g., via chemical means). The as-cast casting may then be machined and subject to further finish treatment (e.g., mechanical treatments, heat treatments, chemical treatments, and coating treatments).

One or more embodiments of the present invention have been described. Nevertheless, it will be understood that various modifications may be made without departing from the spirit and scope of the invention. For example, the principles may be applied as modifications of various existing or yet-developed core manufacture processes. Accordingly, other embodiments are within the scope of the following claims.

What is claimed is:

1. A method for forming an investment casting core comprising:

cutting a patterned core precursor from refractory metal-based sheet, the cutting forming recast along cuts;

growing oxide on non-recast areas;

substantially chemically removing the recast but substantially leaving the oxide; and shaping the core precursor.

2. The method of claim 1 wherein:

the cutting comprises laser cutting.

3. The method of claim 1 wherein:

the precursor comprises in major weight part molybdenum.

4. The method of claim 1 wherein:

the growing comprises thermally growing.

5. The method of claim 1 wherein:

the growing comprises heating in air at essentially atmospheric pressure.

6. The method of claim 1 wherein:

the substantially chemically removing the recast comprises chemically milling for 25-45 seconds.

7. The method of claim 1 wherein:

the substantially chemically removing the recast comprises chemically milling for 20-60 seconds.

8. The method of claim 1 wherein:

the substantially chemically removing the recast comprises chemically milling for 20-30 seconds.

9. The method of claim 1 further comprising:

chemically removing the oxide.

10. The method of claim 9 wherein:

the chemically removing the oxide comprises cleaning with an alkaline cleaning solution.

11. The method of claim 9 wherein the chemically removing the oxide is performed after the substantially chemically removing the recast but before the shaping the core precursor.

12. The method of claim 1 further comprising:

casting a nickel- or cobalt-based superalloy over the core; and chemically removing the core from the superalloy.

13. The method of claim 1 further comprising:

using the core to sacrificially form cooling passageways in a turbine airfoil.

14. A method for investment casting comprising:

forming, according to claim 1, an investment casting core;

casting an alloy over said investment casting core; and destructively removing the investment casting.

15. The method of claim 1 wherein:

the growing and substantially chemically removing facilitate the shaping by improving resistance to cracking caused by the shaping.

16. The method of claim 1 wherein:

the growing is after the cutting.

17. The method of claim 16 wherein;

the substantially chemically removing is after the growing; and the shaping is after the substantially chemically removing.

18. The method of claim 1 further comprising coating the core precursor after the shaping.

19. A method for forming an investment casting core comprising:

cutting a patterned core precursor from refractory metal sheet, the cutting forming recast along cuts;

growing oxide on non-recast areas; and removing the recast areas but substantially leaving the oxide.

20. The method of claim 19 further comprising:

using the core to sacrificially form cooling passageways in a turbine airfoil.

21. A method for investment casting comprising:

forming, according to claim 19, an investment casting core;

casting an alloy over said investment casting core; and destructively removing the investment casting.

22. A method comprising:

cutting a patterned core precursor from refractory metal sheet, the cutting forming recast along cuts;

growing oxide on non-recast areas;

a step for removing the recast areas but substantially leaving the oxide; and shaping the core precursor.

23. The method of claim 22 further comprising a step for removing the oxide.

24. The method of claim 22 further comprising:

casting a nickel- or cobalt-based superalloy over the core; and chemically removing the core from the superalloy.

25. A method for forming an investment casting core comprising:

cutting a patterned core precursor from refractory metal-based material, the cutting forming recast along cuts;

preferentially removing the recast; and shaping the core precursor.

* * * * *